United States Patent [19]

Maki

[11] Patent Number: 4,825,767

[45] Date of Patent: May 2, 1989

[54] WAD FOR SHOTGUN SHOTSHELL

[76] Inventor: Nagatoshi Maki, 2-48-4, Kamiishihara, Chofu-shi, Tokyo, Japan

[21] Appl. No.: 238,759

[22] Filed: Aug. 30, 1988

[51] Int. Cl.[4] ..... F42B 7/08

[52] U.S. Cl. ..... 102/450; 102/532

[58] Field of Search ..... 102/439, 448–463, 102/532, 520–522

[56] References Cited

U.S. PATENT DOCUMENTS 997,566 7/1911 Leach ..... 102/449
4,004,522 1/1977 Furniss et al. ..... 102/450

FOREIGN PATENT DOCUMENTS 2018748 11/1970 Fed. Rep. of Germany ..... 102/449
2370258 7/1978 France ..... 102/532

*Primary Examiner*—Harold J. Tudor
*Attorney, Agent, or Firm*—Michael N. Meller

[57] ABSTRACT

A wad for shotgun shotshell having front and rear discs having a radius substantially identical to a radius of a barrel bore of an associated shotgun, and a connector arranged between and interconnecting the front and rear discs, the connector including two identical connector elements formed by bending circular plates having a radius substantially identical to the radius of the front and rear discs. Each of the connector elements has a planar central portion, two planar outer portions on the opposite sides of the central portion, and two outwardly inclined portions between the central portion and the respective outer portions, to connect the central portion to the respective outer portions. The central portion, the inclined portions and the outer portions of each connector element have circular peripheral surfaces having a curvature radius identical to the radius of the front and rear discs. The inclined portions of each conector element have a same inclination angle with respect to the plane of the central portion and are located in a symmetrical arrangement with respect to the axis of the wad. The connector elements are interconnected at the outer portions, so that the connector elements are opposed in a symmetrical arrangement with respect to a connecting line of the connector elements, with the central portions spaced from one another. The front and rear discs are integrally connected to the central portions of the connector elements.

2 Claims, 4 Drawing Sheets

Fig. 9 (PRIOR ART)
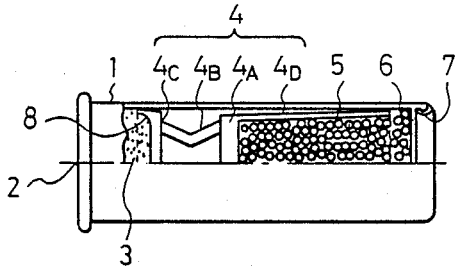
Fig. 10 (PRIOR ART)
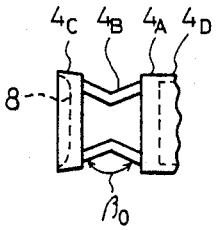
Fig. 12 (PRIO ART)
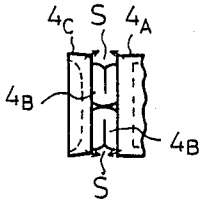
Fig. 11 (PRIOR ART)
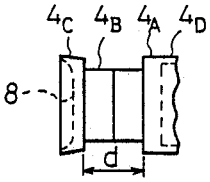
Fig. 13 (PRIOR ART)
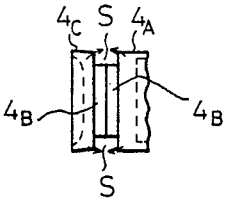

WAD FOR SHOTGUN SHOTSHELL

BACKGROUND OF THE INVENTION

1. Field of the Invention

The present invention relates to an improved wad for a shotgun shotshell.

2. Description of the Related Art

FIG. 9 shows an example of a known shotshell for shotgun, in which a propellant 3, a wad 4, a shot 5, and a cover 6, in this order, are housed in a case 1 having a primer (not shown) at a rear center portion 2 thereof. These elements are held in the case 1 by a roll crimp 7.

The wad 4 is usually made of a plastic mold, has a high flexibility and elasticity, and includes a cup wad 4C, which seals the propellant gas, and a container consisting of a disc 4A and a sleeve 4D and connected to the cup wad 4C by a cushion 4B. The cushion 4B has two rectangular plates which are bent inward toward each other at the center portions thereof, and which are located in a symmetrical arrangement with respect to the center line of the shotshell, as can be seen in FIGS. 10 and 11.

When the explosion of the propellant 3 takes place, the cushion 4B, which comes under pressure from the cup wad 4C due to the relatively low explosion gas pressure immediately after the explosion, is deformed and bent so that the distance d (FIG. 11) between the disc 4A and the cup wad 4C is decreased. The subsequent increase of the explosion gas pressure causes a further deformation of the cushion 4B, resulting in the cushion 4B being completely folded, as shown in FIGS. 12 and 13, and thus the cushion 4B is brought into close contact with the disc 4A and the cup wad 4C. In this state, the shotshell is passed through the barrel of a shotgun and fired rom the muzzle thereof.

Since both the cup wad 4C and the disc 4A are in the form of circular disc plates, spaces S are produced in the barrel and around the cushion 4B, which is completely folded into a rectangle or a square between the cup wad 4C and the disc 4A as shown in FIG. 13. Due to the presence of the spaces S, the cup wad 4C, which is subject to an extremely high explosion gas pressure, can be easily deformed and pushed into the spaces S, as shown by arrows in FIGS. 12 and 13. This deformation causes a leakage of the propellant gas, and may also cause the cup wad 4C to crack, particularly in a cold season such as winter.

Various shapes of cushions are known; for example, a cushion 4E shown in FIG. 14 has an elliptical opening 9. Cushions having openings of different cross sectional shapes are also known (not shown), but in these known cushions, spaces corresponding to the spaces S in FIGS. 12 and 13 always exist when the cushions are compressed or deformed, and a solution to the deformation of the cup wad due to the propellant gas pressure upon firing of the shotshell from the muzzle has not been found until now.

A shotshell having a slug loaded therein in place of the shot (pellets) is also known. In this type of projectile, as shown in FIG. 14, a disc 4F of a wad without a sleeve 4D (FIG. 9) is provided on the center portion thereof with a projection 4G fitted in a corresponding recess 21 of a slug 20, to connect the slug 20 and the wad. In a projectile shown in FIG. 15, the cushion 4B is the same as that shown in FIGS. 10 and 11, and the slug 20 is connected to a wad having the cushion 4B. Immediately after the projectile is fired from the muzzle, the cushion 4B tends to return to the free state before compression, as shown in FIG. 10, but during this return, it is possible that the two rectangular plates of the cushion 4B will have different bent angles $\beta_0$, $\beta_1$ ($\beta_0 > \beta_1$) in the returned state, due to residual stress, or dimensional irregularities, etc., occurring during the molding process. Due to the irregular returned posture of the cushion 4B, as shown in FIG. 15, the cup wad 4C is inclined by an inclination angle $\gamma$, with respect to the center line of the projectile, resulting in an asymmetry of the projectile, and this results in a worsened grouping (decreased hit accuracy). The same is true for other projectiles having other shapes of cushions.

The primary object of the present invention is, therefore, to provide a wad for a shotgun shotshell which is free from the above-mentioned drawbacks, i.e., which can prevent the deformation of the cup wad.

BRIEF DESCRIPTION OF THE DRAWINGS

The invention will be described below in detail, with reference to the drawings showing embodiments of the present invention, in which:

FIG. 9 is a partial sectional view of a known shotshell for shotgun;

FIG. 10 is a front elevational view of a cushion shown in FIG. 9;

FIG. 11 is a side elevational view of FIG. 10;

FIGS. 12 and 13 are a front elevational view and a side elevational view of a cushion shown in FIG. 9, when in a compressed position;

DESCRIPTION OF THE PREFERRED EMBODIMENTS

Figure 1:
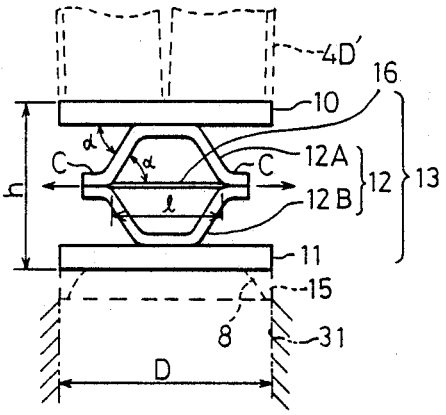
FIG. 1 is a front elevational view of a wad according to the present invention.
Figure 2:
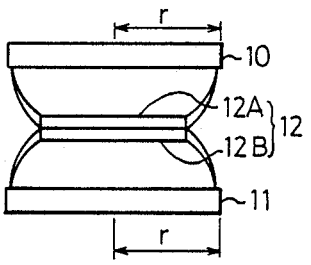
FIG. 2 is a side elevational view of FIG. 1.
Figure 14:
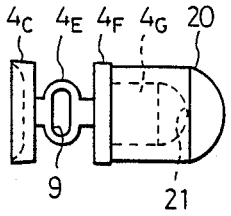
Fig.14 (PRIOR ART)
FIG. 14 is a front elevational view of a known different projectile having a wad; and, FIG. 15 is a front elevational view of another, different projectile having a slug, showing an asymmetrical deformation of a cushion.
Figure 15:
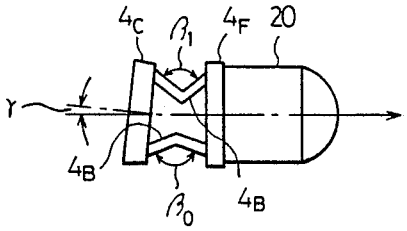
Fig.15 (PRIOR ART)

As shown in FIGS. 1 and 2, a wad 13 made of a flexible and elastic plastic has a front disc 10 opposed to a shot (or a slug), a rear disc 11 located adjacent to the propellant 3 (FIG. 9), and a connector 12 which consists of two identical connector elements 12A and 12B and which connects the front and rear discs 10 and 11. The front disc 10 and the rear disc 11 are made of circular plates having a radius r substantially identical to that of a barrel bore 31 of an associated shotgun. The diameter D of the barrel bore is shown in FIG. 1. It should be appreciated that a slitted sleeve 4D' (shown by an imaginary line in FIG. 1) and/or a projection 4G (FIG. 14) can be provided on the front disc 10. In addition, it is possible to provide an annular sealing member 15 integral therewith, to form a recess 8 on the side of the rear disc 11 adjacent to the propellant 3 (FIG. 9), so that the rear disc 11 has a function similar to the cup wad 4C shown in FIG. 9.

Figure 4:
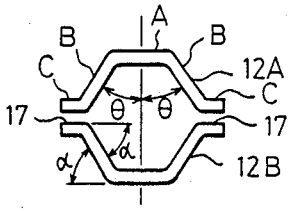
FIG. 4 is a front elevational view of a connector shown in FIG. 1, but with two connector elements shown in a separated position, for clarification only.
Figure 5:
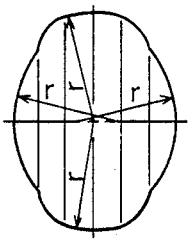
FIG. 5 is a plan view of one connector element of a connector shown in FIG. 4.
Figure 6:
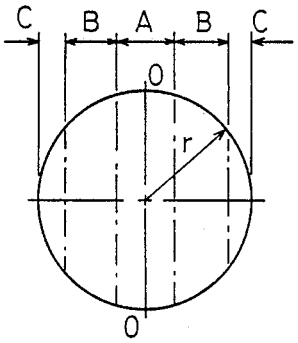
FIG. 6 is a developed plan view of one connector shown in FIG. 5.

The connector element 12A has a planar central portion A, two right and left outwardly inclined portions B on opposite sides of the central portion and two right and left planar outer portions C connected to the central portion through the respective inclined portions B. The connector element 12A has a uniform thickness. The connector element 12A is made of a circular plate having a center on a center line 0—0' of the central portion A, when viewed in a developed plan view (FIG. 6). The radius of the circular plate is identical to or slightly smaller than the radius of the front disc 10 and the rear disc 11. The boundary lines (bending lines) between the central portion A, the inclined portions B and the outer portions C are in parallel with each other. The central portion A, the two inclined portions B and the two outer portions C are located in a symmetrical arrangement with respect to an imaginary plane including the center line 0—0' of the central portion A and the axis of the wad 13. Namely, the connector element 12A is formed by bending the circular disc shown in FIG. 6 in such a way that the central portion A is perpendicular to the axis of the wad 13, the inclined portions B are symmetrically inclined at an inclination angle $\theta$ with respect to the axis of the wad, and the outer portions C are perpendicular to the axis of the wad (FIG. 4). Accordingly, the peripheral surfaces of the central portion A, the inclined portions B, and the outer portions C are circular surfaces having a curvature radius r: Note, this is one of the most significant features of the present invention.

The connector element 12B, which is opposed to the rear disc 11, is identical to the connector element 12A, so that when the connector element 12B is connected to the connector element 12A, the connector element 12B is inverted with respect to the connector element 12A. Namely, the connector element 12B is opposed to the connector element 12A in a symmetrical arrangement with respect to the connecting line therebetween, in which the central portion A, the inclined portions B, and the outer portions C of the connector element 12A are directly opposed to those of the connector element 12B. The connector elements 12A and 12B are connected to each other at corresponding surface portions 17 of the outer portions C (FIG. 4), in such a way that the two central portions A of the connector elements are spaced from one another.

The thus assembled connector 12, which corresponds to the cushion 4B in FIG. 9, is secured to the front disc 10 and the rear disc 11 with a common axis there between, to complete the wad 13 as shown in FIG. 1. The connection between the connector 12 and the front and rear discs 10 and 11 can be carried out, for example, by welding, adhesion, or male-female fitting, etc. Preferably, to decrease manufacturing costs, the wad 13 is integrally molded by injection molding. Note that the molding dies used in such an injection molding can be simplified, since the curved surfaces of the wad are all circular or cylindrical.

The wad 13 of the invention can be used in place of the wad 4 shown in FIG. 9. When the rear disc 11 has the sealing member 15 shown in FIG. 1, the wad 13 is located directly opposited the propellant 3. On the other hand, when the wad 13 does not have the sealing member 15, a cup wad well known per se is located between the propellant 3 and the wad 13. If necessary, an additional filler wad (not shown) can be inserted between the cup wad and the wad 13.

Figure 3:
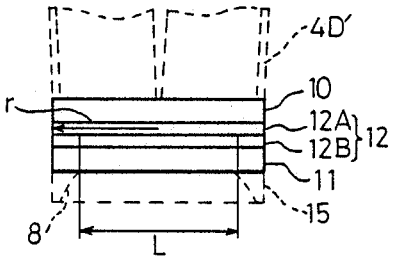
FIG. 3 is a front elevational view of a wad according to the present invention, shown in a compressed position in which the wad is compressed by the explosion of a propellant.

The function of the wad 13 of the present invention is fundamentally identical to that of the wad having a conventional cushion, except when the connector 12 is compressed. When the explosion of the propellant 3 (FIG. 9) takes place, the connector 12 of the wad 13 is deformed so that the inclination angle $\alpha$ (FIGS. 1 and 4) of the connector elements 12A and 12B with respect to the connecting line therebetween becomes zero, thus resulting in a close contact of the two connecting elements, as shown in FIG. 3. Namely, in the state shown in FIG. 3, the connector elements 12A and 12B are compressed and deformed, so that two identical circular discs having a uniform thickness and a radius r are superimposed one upon the other without a gap therebetween.

In other words, since both the connector elements 12A and 12B present circles having a radius r when pressed into a flat plane, no space S (FIGS. 12 and 13) exists between the front disc 10, the rear disc 11, and the connector 12, and accordingly, the rear disc 11 including the sealing member 15 can not be deformed, thus preventing a leakage of the explosion gas and the occurrence of cracks, as mentioned before.

Note that, where a fold crimp (also called a pie-shape crimp) is used instead of the roll crimp 7 in FIG. 9, a force which pushes the shot 5 inward is produced during the folding operation of the crimp. Therefore, the connector 12 of the wad 13 must have a rigidity sufficient to resist the inward force. If the connector 12 does not have such a rigidity, it is possible to provide a breakable member or piece 16, on the connector 12, as shown in FIG. 1. In the illustrated embodiment, the breakable member 16 is in the form of a thin plate and extends in a tight fit between the connector elements 12A and 12B to connect the inner peripheral edges of the right and left outer portions C of the connector elements 12A and 12B, to increase the rigidity of the connector 12.

When the connector 12 is compressed by the explosion of the propellant 3, the outer portions C of the connector elements 12A and 12B are displaced outward, as shown by arrows in FIG. 1, so that the length l of the breakable member 16 is extended to L (FIG. 3), but, because of a sudden extension thereof, the breakable member 16 is broken or cut. Therefore, the breakable member 16, which is made of a thin plate lying in a plane perpendicular to the axis of the wad in the illustrated embodiment, can be replaced by a thin round or angle bar or the like.

Since a cushion of a conventional wad does not have a portion that extends at the compression thereof, unlike the wad according to the present invention, it is impossible to adopt the philosophy of the provision of such a breakable member to increase the rigidity of the cushion: Note, the provision of the breakable member, which easily increases the rigidity of the connector (i.e., the cushion of the wad), is also one of the significant features of an aspect of the present invention.

Figure 7:
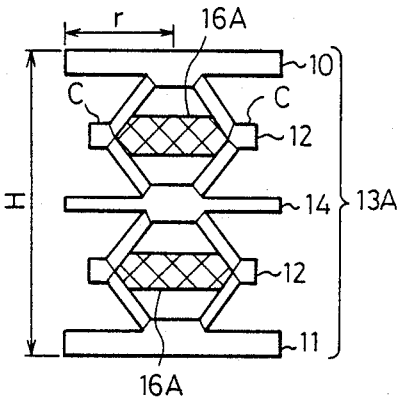
FIG. 7 is a front elevational view of another wad having a breakable band, according to another aspect of the present invention.

The height h of the wad 13 shown in FIG. 1 can be properly determined in accordance with the widths of the central portions A, the inclined portions B, and the outer portions C, and the inclination angle $\theta$ of the connector elements 12A and 12B. Nevertheless, the height h of one wad can not be larger than a maximum height limited by the following equation: $A/2+B+C=r$. Therefore, if a height of the wad larger than the above-mentioned maximum height is necessary, a wad 13A having two connectors as shown in FIG. 7 can be used. In FIG. 7, the wad 13A has two connectors 12 interconnected by an intermediate disc 14 provided therebetween. The wad 13A shown in FIG. 7 is a molded single piece. Each connector 12 has a breakable band 16A, a center of which is on the axis of the wad 13A. The height H of the wad 13A is larger than the height h of the wad 13 ($H>h$).

It can be easily understood that the height of the wad can be increased by increasing the number of the connectors in the wad.

Figure 8:
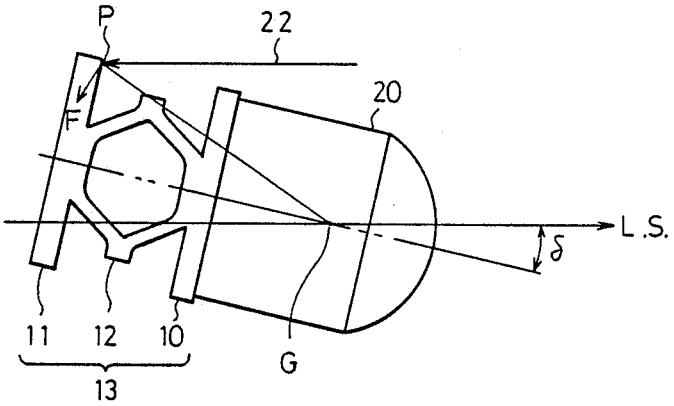
FIG. 8 is a schematic view of a projectile having a wad to which a slug is connected, showing an inclined posture thereof.

FIG. 8 shows a posture of a projectile having a slug 20 connected to the wad 13 of the present invention, which is a molded single piece, after being fired from a muzzle. In this posture, it is assumed that the projectile is inclined by an angle $\delta$ with respect to the line of sight (L.S.). By way of an example, the rear end of the projectile, i.e., the corner portion (point) P of the inclined rear disc 11, is exemplified in the following discussion.

The point P receives an aerodynamic force due to the relative wind in the direction shown at 22, during flight. Assuming that the component of the aerodynamic force in the direction normal to the line segment GP connecting the center G of gravity and the point P is F, the projectile is subject to a restoring moment which is represented by $F\times GP$, so that the projectile rotates about the center G of gravity in the counterclockwise direction, resulting in an immediate correction of the inclined posture of the projectile. Namely, the axis of the projectile coincides with the line of sight.

The refraction angle $\theta$ (FIGS. 1 and 4) of the connector elements 12A and 12B when the connector 12 is returned to the free state after being fired from the muzzle, is an acute angle. This acute angle $\alpha$ contributes to an absence of residual strain in the connector 12. The rear disc 11 lies in a plane perpendicular to the axis of the projectile, so that the projectile flies through the air while keeping a complete symmetrical posture with respect to the axis thereof.

On the contrary, in the conventional wad 4 shown in FIG. 10, the refraction angle $\beta_0$ is an obtuse angle, and accordingly, the above-mentioned effect can not be expected.

As can be understood from the foregoing, since the wad 13 of the present invention also functions as a stabilizer of the projectile, the hit accuracy can be increased. Namely, in the wad according to the present invention, not only the leakage of the propellant gas and the production of cracks in the wad can be prevented, but also the hit accuracy can be largely increased, particularly when a wad connected to a slug is used.

It should be appreciated that the projectile referred to in the present invention can be either pellets (shot) or a slug.

We claim:

1. A wad to be loaded between a propellant and at least one projectile of a shotshell for a shotgun, comprising front and rear discs having a radius substantially identical to a radius of a barrel bore of an associated shotgun, and a connector between and interconnecting the front and rear discs, said connector comprising two identical connector elements formed by bending circular plates having a radius substantially identical to the radius of the front and rear discs, along predetermined straight bending lines each of said connector elements being provided with a planar central portion, two planar outer portions on the opposite sides of the central portion, and two outwardly inclined portions between the central portion and the respective outer portions to connect the central portion to the respective outer portions, said central portion, said inclined portions, and said outer portions of each connector element having circular peripheral surfaces having a curvature radius identical to the radius of the front and rear discs, the plane of said central portion of each connector element coaxially lying in a plane perpendicular to the axis of the wad, said two inclined portions of each connector element having a same inclination angle with respect to the plane of the central portion and being located in a symmetrical arrangement with respect to the axis of the wad, said straight bending lines between the central portion and the inclined portions of each connector element being parallel with each other and being spaced at an equidistance from a center line of the central portion extending in the plane thereof, the straight bending lines between the inclined portion and the corresponding outer portions of each connector element being parallel with each other and being spaced at an equidistance from the first mentioned respective bending lines, said outer portions lying in a plane perpendicular to the axis of the wad, connector elements being interconnected at the outer portions, so that the connector elements are opposed in a symmetrical arrangement with respect to a connecting line of the connector elements, with the central portions spaced from one another, said front disc being integrally connected to the central portion of one of the connector elements and said rear disc being integrally connected to the central portion of the other connector element, so that the front disc, the rear disc and the connector have a common center axis, said connector being deformed into a circular disc shape by an explosive pressure of the propellant.

2. A wad according to claim 1, further comprising a breakable member which is broken when said connector is deformed into the circular disc shape by an explosive pressure of the propellant and which connects inner edges of the outer portions of the connector elements.

* * * * *